US010113353B2

(12) United States Patent
Kraeutler

(10) Patent No.: US 10,113,353 B2
(45) Date of Patent: Oct. 30, 2018

(54) HIGH SPEED DOOR

(75) Inventor: Bernard Kraeutler, Dunieres (FR)

(73) Assignee: ASSA ABLOY ENTRANCE SYSTEMS AB, Landskrona (SE)

( * ) Notice: Subject to any disclaimer, the term of this patent is extended or adjusted under 35 U.S.C. 154(b) by 0 days.

(21) Appl. No.: 13/700,861

(22) PCT Filed: Jun. 1, 2011

(86) PCT No.: PCT/FR2011/051258

§ 371 (c)(1),
(2), (4) Date: Feb. 8, 2013

(87) PCT Pub. No.: WO2011/151600

PCT Pub. Date: Dec. 8, 2011

(65) Prior Publication Data

US 2013/0133843 A1 May 30, 2013

(30) Foreign Application Priority Data

Jun. 1, 2010 (FR) ..... 10 54276

(51) Int. Cl.
*E06B 9/58* (2006.01)
*E06B 3/44* (2006.01)
(Continued)

(52) U.S. Cl.
CPC ..... *E06B 3/44* (2013.01); *E05F 15/60* (2015.01); *E06B 9/0692* (2013.01); *E06B 9/13* (2013.01);
(Continued)

(58) Field of Classification Search
CPC ..... E06B 9/08; E06B 9/11; E06B 9/17061; E06B 9/42; E06B 9/581; E06B 9/582;
(Continued)

(56) References Cited

U.S. PATENT DOCUMENTS 4,779,537 A 10/1988 Hafner et al.
4,854,363 A * 8/1989 Fouquet ..... 160/98
4,919,384 A * 4/1990 Grimberg ..... 248/646
5,246,053 A * 9/1993 Kraeutler ..... 160/84.02
5,291,932 A * 3/1994 Kraeutler ..... 160/84.01
5,365,990 A * 11/1994 Ueda ..... E06B 9/15 160/133
(Continued)

FOREIGN PATENT DOCUMENTS

DE 2333953 A1 1/1975
DE 3443470 A1 5/1986
(Continued)

OTHER PUBLICATIONS

International Search Report dated Sep. 27, 2011 re: PCT/FR2011/051258; pp. 2; citing: EP 0 220 096 A1, DE 23 33 953 A1, DE 88 10 173 U1, EP 2 071 118 A2, DE 34 43 470 A1 and DE 20 2007 017061 U1.

*Primary Examiner* — Katherine W Mitchell
*Assistant Examiner* — Jeremy C Ramsey
(74) *Attorney, Agent, or Firm* — Cantor Colburn LLP

(57) ABSTRACT

This high speed door (1), for closing or opening an opening made in a wall, comprises a bearing structure (3, 4) to which are attached a flexible curtain (2) and a drive system (5) enabling the curtain (2) to be moved from a closed position into an open position in which the curtain (2) is concertina-folded into the top of the opening. According to the invention, the bearing structure (3, 4) comprises two U-shaped vertical uprights (3) comprising a web (9) and two flanges (10) between which the curtain (2) is folded, each upright (3) being formed of at least one one-piece section piece (6) incorporating at least one cavity (7) oriented in the longitudinal direction of the section piece (6).

11 Claims, 5 Drawing Sheets

(51) Int. Cl.
*E06B 9/06* (2006.01)
*E06B 9/13* (2006.01)
*E05F 15/60* (2015.01)

(52) U.S. Cl.
CPC ..... *E06B 9/582* (2013.01); *E05Y 2900/00* (2013.01); *E05Y 2900/106* (2013.01)

(58) Field of Classification Search
CPC ..... E06B 9/56; E06B 9/58; E06B 9/13; E06B 3/44; E06B 9/0692; E06B 9/17; E06B 2009/587; E06B 3/26; E06B 1/30
USPC ..... 160/188, 266, 267.1, 268.1, 269, 270, 160/271, 272, 273.1, 274; 16/96 R; 238/151, 176, 179
See application file for complete search history.

(56) References Cited

U.S. PATENT DOCUMENTS

2003/0173041 A1* 9/2003 Simon ..... E06B 9/84 160/267.1
2007/0277942 A1 12/2007 Dondlinger et al.
2010/0252645 A1* 10/2010 Maurer et al. ..... 238/123

FOREIGN PATENT DOCUMENTS

DE 8810173 U1 9/1988
DE 202007017061 U1 4/2008
EP 0220096 A1 4/1987
EP 2071118 A2 6/2009

* cited by examiner

HIGH SPEED DOOR

TECHNICAL FIELD

The present invention relates to a so-called high-speed flexible curtain door.

BRIEF DISCUSSION OF RELATED ART

A high-speed door comprises a support structure that is applied in a wall in which an opening is made.

The structure comprises vertical uprights and a lintel that connects the upper ends of the vertical uprights.

The function of the structure is to support, guide, and ensure the movement of the curtain between its open and closed positions. The curtain is traditionally made from a flexible material of the PVC type and is provided with reinforcing bars that may be flexible.

The structure of the door is generally made from metal section pieces that are assembled on-site.

Using metal section pieces is expensive. Steel is a heavy material that must be shaped, pierced, welded, and treated against corrosion, which makes it a material with a high associated labor cost. Its on-site use also requires piercing, riveting, and/or screwing operations.

Furthermore, steel is a poor acoustic and thermal insulator.

Known from document EP 0 220 096 is a high-speed door upright that is made up of a metal section piece inside which an insulating fitting is engaged. The fitting is attached in the uprights existing in place of rollers that are positioned on the vertical edges of the curtain.

BRIEF SUMMARY

One aim of the invention is to propose a door having a door structure that resolves the drawbacks of the prior art.

The present invention relates to a high-speed door for closing or opening an opening formed in a wall. The door comprises a bearing structure to which are attached a flexible curtain and a drive system enabling the curtain to be moved from a closed position into an open position in which the curtain is concertina-folded into the top of the opening; the bearing structure comprises two U-shaped vertical uprights comprising a web and two flanges between which the curtain is folded, each upright being formed of at least one one-piece section piece incorporating at least one cavity oriented in the longitudinal direction of the section piece.

The invention thus proposes to produce the structure for a high-speed door with honeycomb section pieces. The door structure thus formed is light, and thermally and acoustically insulating. The use of single-piece honeycomb section pieces is beneficial in numerous ways.

According to one provision of the invention, the section piece incorporates a grid of cavities distributed over the entire transverse section of the upright. Furthermore, the door comprises a lintel comprising at least one single-piece section piece incorporating a grid of cavities oriented longitudinally.

Furthermore, a reinforcing means such as at least one iron is engaged in at least one cavity.

A thermal and/or acoustic insulating means such as a foam may also be engaged in at least one cavity.

At least one upright may comprise at least two honeycomb section pieces connected in pairs to a junction platen provided with pins designed to be engaged in the cavities of the two section pieces placed end-to-end.

This arrangement is important, as it is thus possible to produce doors of all sizes from modular honeycomb single-piece section pieces.

In practice, the lintel may comprise at least two section pieces connected in pairs by a junction element.

Specifically to the invention, the lintel is also designed to be made with modular honeycomb section pieces. The door according to the invention comprises a single type of section piece that is used for the uprights and the lintel.

It is provided that at least one flange has a return at its free end turned toward the inside of the section piece.

Alternatively, it is considered that at least one flange has an attachment portion designed to receive an end section piece provided with a return.

Furthermore, the door comprises two brackets, each bracket having a platen moving forward against the web of the section pieces.

Furthermore, the section piece can have an attachment portion making it possible to fasten a secondary section piece.

Furthermore, the section piece comprises two female slots in which two complementary male studs are engaged to fasten the secondary section piece.

Furthermore, at least one electric member is fixed on an upright whereof the connecting wire is engaged in one of the cavities of the section piece forming the upright.

Concretely, at least one of the elements of the group comprising a transverse connecting bracket, an upright, or a junction element of the crosspiece or a junction platen of an upright allows direct or indirect fastening to the structure of the building or the opening.

BRIEF DESCRIPTION OF THE DRAWINGS

For proper understanding of the invention, the invention is described in reference to the appended drawing showing, as a non-limiting example, one embodiment of a door according to said invention.

DETAILED DESCRIPTION

Figure 1:
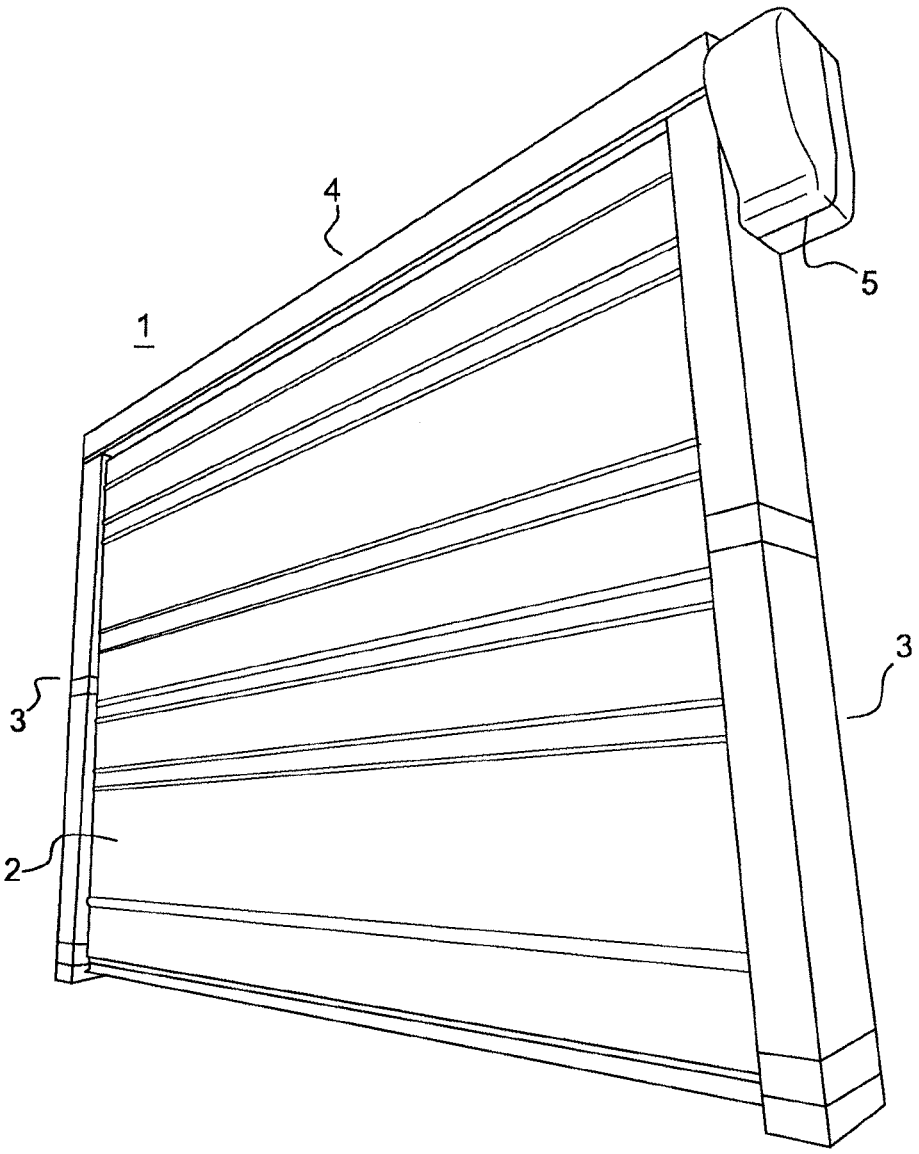
FIG. 1 is a perspective view of a high-speed door according to the invention.

As shown in FIG. 1, the door 1 according to the invention has a bearing structure, the function of which is to bear a flexible curtain 2 and the drive means that make it possible to move the curtain 2 between its open and closed positions.

The bearing structure of said door comprises two uprights 3 that are placed on either side of an opening and the lintel 4 that will be placed at the upper end of the two uprights 3.

As shown in FIG. 1, this door 1 is provided with driving means comprising an electric motor and a reducer that are protected by a casing 5.

Figure 2:
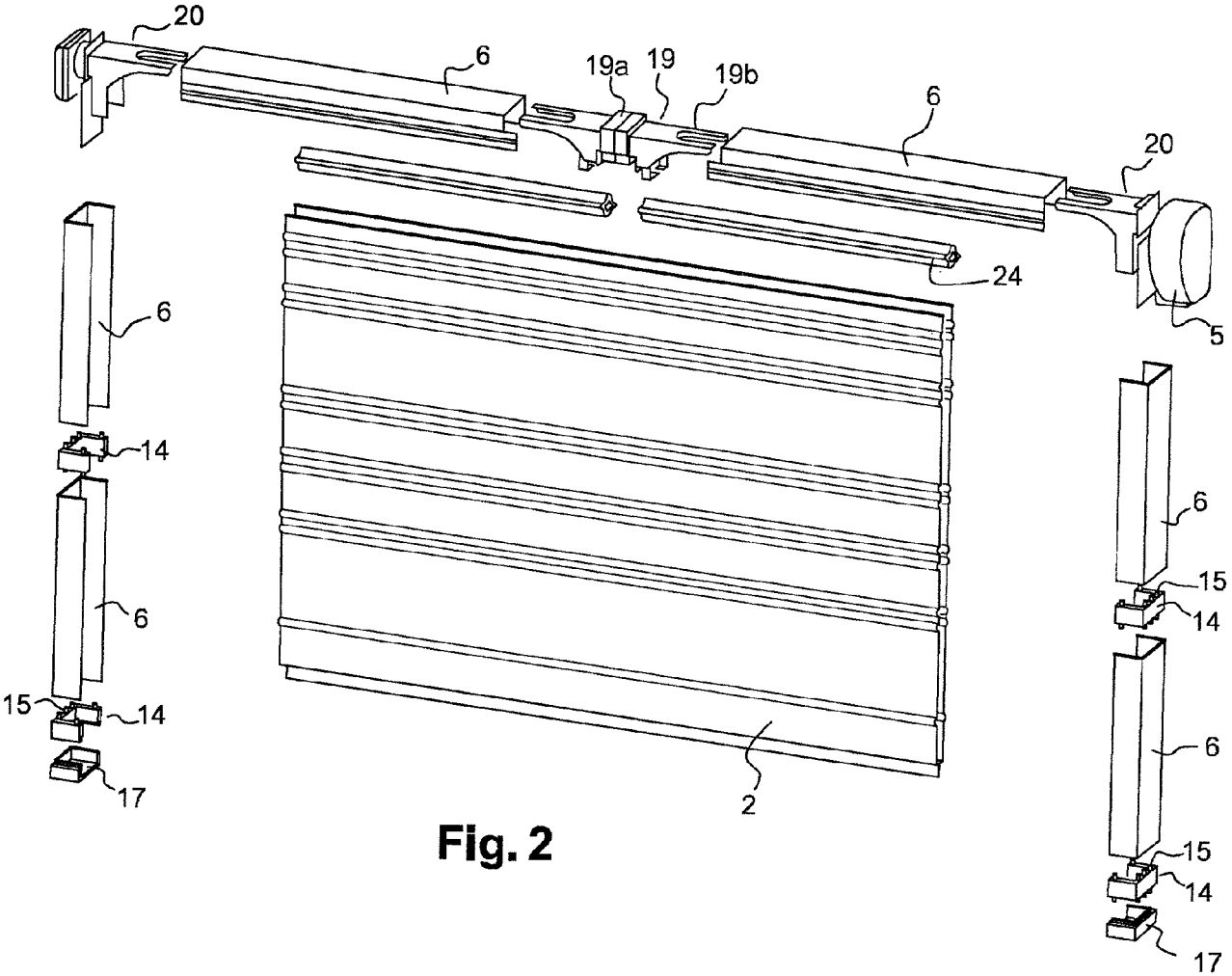
FIG. 2 is an exploded view of said door.
Figure 3:
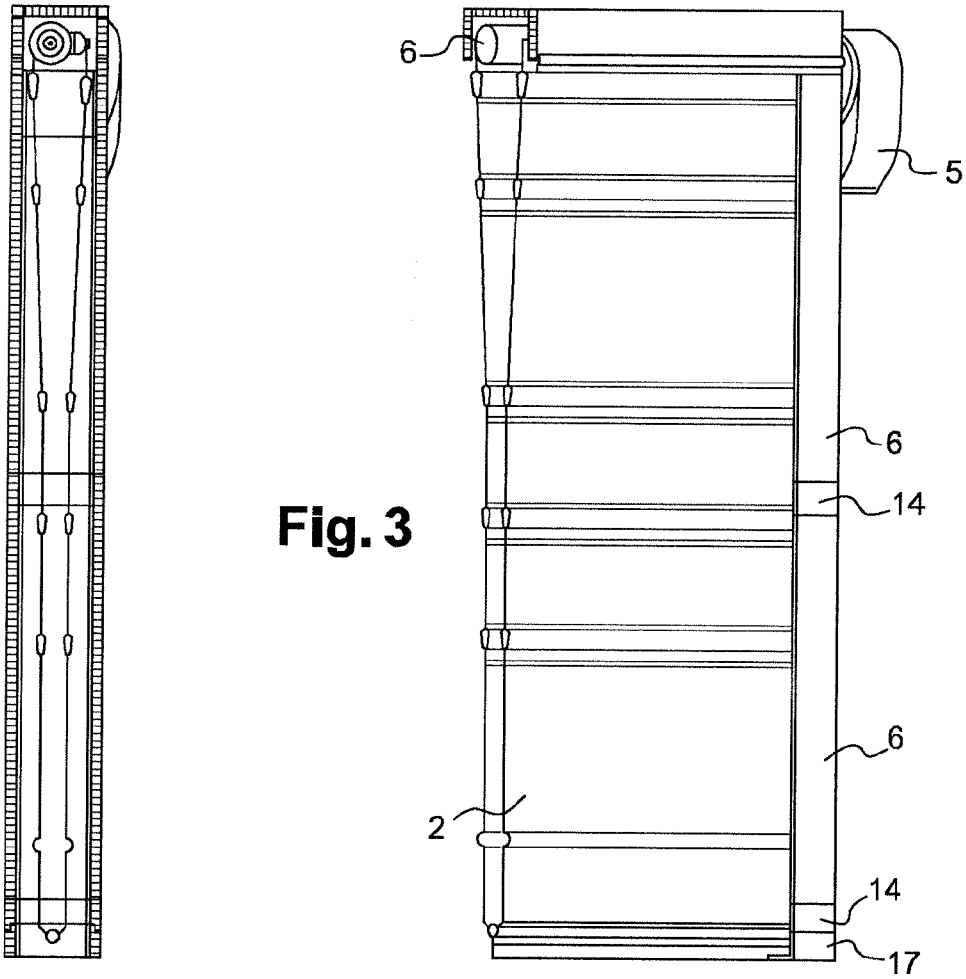
FIG. 3 shows said door in cross-section along III-III of FIG. 1, FIGS. 4, 5 and 6 show a cross-sectional view of several embodiments of the uprights of the door.

FIG. 2 shows some of the original arrangements of the door according to the invention.

In fact, as shown in the figure, said door is made up of an original structure that is formed by honeycomb section pieces 6 that are found at the uprights 3 as well as its lintel 4.

In the embodiment shown in FIG. 2, the honeycomb section pieces 6 that make up the uprights 3 and the lintel 4 are identical.

Figure 4:
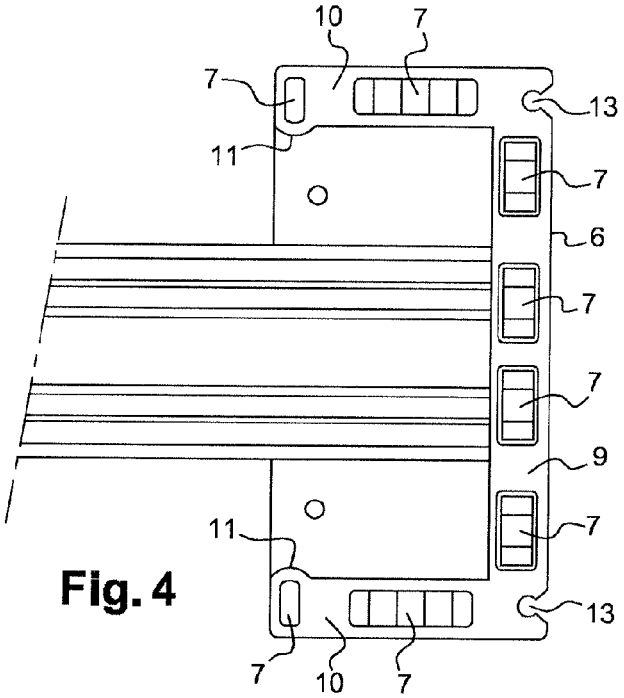

FIG. 4 more particularly shows the structure of the honeycomb section pieces 6 that form the uprights 3 and the lintel 4.

These are honeycomb section pieces 6 obtained by extruding a plastic.

"Honeycomb section pieces 6" refers to a section piece provided with a multitude of longitudinal chambers or cavities or cavities 7 formed in the thickness of said section piece.

In the illustrated example, the honeycomb section pieces 6 are generally U-shaped comprising a web 9 and two parallel flanges 10.

It will be noted that the end of each of the flanges 10 has a return 11, the function of which will appear later.

Quite originally, it will be noted that an attachment portion is provided in the web 9 of the honeycomb section pieces 6; in the case at hand, these are generally female slots 13 that are positioned at each end of the web 9.

The function of the attachment portions will be addressed later.

Returning to FIG. 2, one can see that the uprights 3 are each made up of two honeycomb section pieces 6 placed end-to-end and connected to one another by a junction platen 14.

This junction platen 14 may be a molded piece whereof the transverse section is U-shaped identically to the honeycomb section pieces 16 making up the upright 3.

This junction platen 14 is also equipped with pins 15 that engage in cavities 7 of the honeycomb section pieces 6 placed end-to-end.

A pedestal 17 is provided at the junction of the upright 3 with the ground and may be fixed to the ground.

This pedestal 17, which also has a U-shaped transverse section, can receive a lower junction platen 14 that is provided with pins 15 allowing the insertion into the cavities 7 of the section piece 6 that forms the base of the upright.

Two structurally symmetrical brackets 20 are provided at each end of the lintel 4. Each bracket 20 in fact comprises a vertical portion that is pressed inside the section piece against the web 9 of the latter part and a horizontal portion that is placed in the honeycomb section pieces 6 making up the lintel 4.

In the example illustrated in FIG. 2, the lintel 4, in light of the dimensions of the door, is made up of two honeycomb section pieces 6 placed end-two-end and connected to one another by a junction element 19.

This junction element 19 comprises a central portion 19*a* that forms a shoulder against which the two section pieces bear on either side, and also comprises two support plates 19*b* against which the webs of each of the section pieces making up the lintel 4 are fixed.

In FIG. 2, one can also see a shaft 24 which, in the case at hand, is made in two parts. The shaft 24 is driven by the driving means, which are housed at the bracket 20 which, in the example of FIG. 2, is at the upper right upright 3, while at the upper left upright 3, the shaft is supported by a bearing formed in the bracket 20.

The curtain, which is illustrated in FIG. 2, is a curtain that operates by folding.

In the illustrated case, it is, as a non-limiting example, a so-called double curtain, i.e. it is made up of two substantially parallel, flexible PVC screens.

A single screen could of course also be implemented in place of the door of FIG. 2.

During operation, the curtain 2 can be raised through the action of straps (not shown) which are connected to the shaft 24 on the one hand, and connected to the lower portion of the curtain 2 on the other hand, such that when the strap(s) wind around the shaft 24, the lower portion of the curtain 2 rises, thereby forming concertina folds that are distributed in the shown case of a double curtain on either side of the closing plane of the door.

The returns 11 allow the curtain 2 to bear so as to improve the overall sealing of the door.

The door according to the invention is extremely advantageous in many ways.

In fact, its structure is made up of honeycomb section pieces 6 that may be made from a plastic. Unlike the doors of the prior art made from metal, the plastic section pieces have the advantage of being light and thermally and acoustically insulating. Furthermore, they can withstand corrosion, without needing to be treated using a particular coating.

One can also see that the section pieces may be produced by extruding-type machines, then simply cut to the particular dimensions of an opening; owing to the junction platens of the uprights 3 and the junction element of the lintel 4, it is possible, extremely simply and by preparing the set of section parts in the plant, to adapt them to any type of opening, without using welds.

Furthermore, the honeycomb structure of the uprights 3 may be adapted to various loads.

In fact, it is possible to increase the inertia of the latter parts by reinforcing them with metal rounds, for example.

The invention therefore makes it possible to reduce the overall production, transport, and installation costs.

Figure 5:
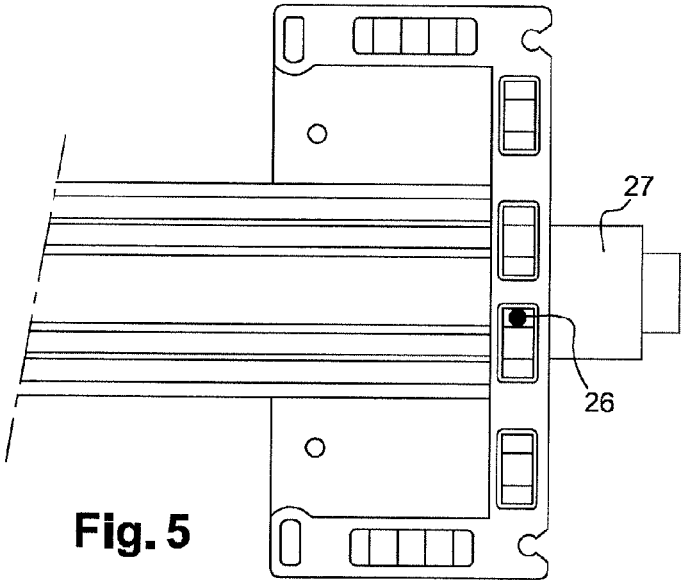

It is also considered to use the cavities to run electrical conductors 26 that for example connect the control button 27, as can for example be seen in FIG. 5.

Figure 6:
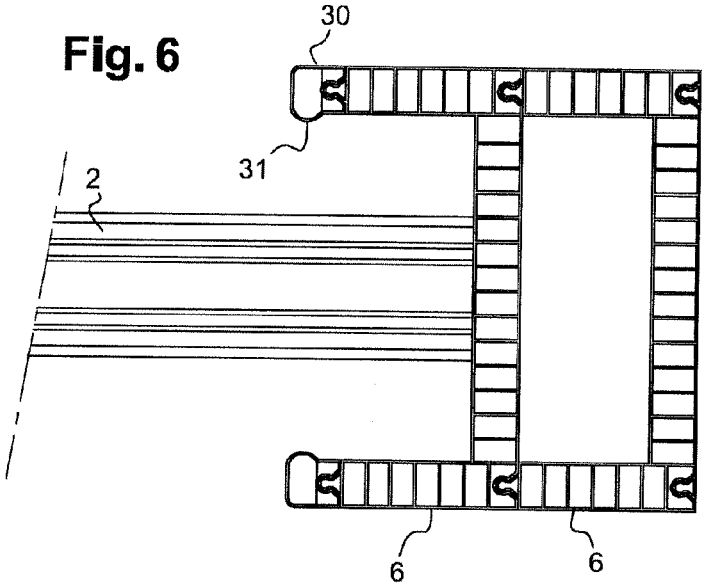

Another very interesting aspect of the invention is the presence of attachment portions on the web, which make it possible to fix a secondary section piece 6, also an extruded honeycomb section piece, so as for example to receive a counterweight, as shown in FIG. 6.

Figure 7:
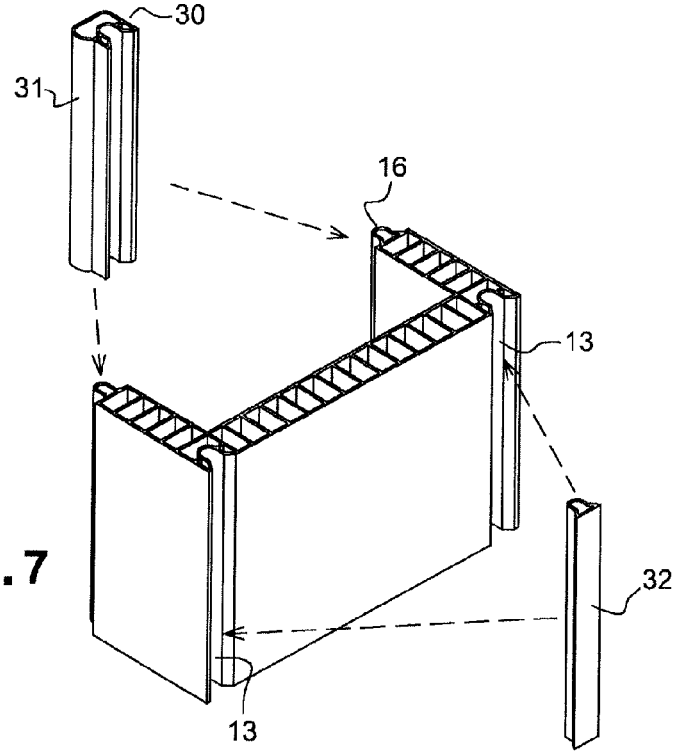
FIG. 7 shows an exploded view of the various elements making up a door upright.

FIG. 6 shows the configurable aspect of the door according to the invention. In fact, as shown in the figure, the upright 3 comprises two identical honeycomb section pieces 6 that are fixed on one another using male/female attachment portions. Each honeycomb section piece 6 has, as shown in FIGS. 6 and 7, two female slots 13 on either side of the web 9, while each of the flanges of the section pieces 6 are provided with a male attachment portion or a stud 16 with a shape complementary to that of the female slots 13.

An end section piece 30 may snap on each of the male studs 16. This section piece is provided with a return 31 that makes it possible to produce an anti-wear sliding surface with the curtain 2 and the ends of its horizontal bars.

It is also provided that the finishing section pieces 32 may be fixed in the female slots 13 of the section piece 6.

The invention is of course not limited to the embodiment described above, but on the contrary encompasses all embodiments thereof.

The invention claimed is:

1. A high-speed door for closing or opening an opening formed in a wall, the door comprising:

a bearing structure to which is attached a flexible curtain and a drive system enabling the curtain to be moved from a closed position into an open position in which the curtain is concertina-folded into a top of the opening, wherein the bearing structure comprises two cross-sectional U-shaped vertical uprights each comprising a web and two flanges extending perpendicularly from opposite ends of the web between which the curtain is folded, each U-shaped vertical upright being formed of a plurality of one-piece upright section pieces, wherein at least one one-piece section piece incorporates at least one cavity oriented in a longitudinal direction of the section piece;

a lintel comprising a plurality of lintel section pieces each incorporating at least one cavity oriented longitudinally, said lintel enclosing a shaft used to operate the flexible curtain; and an attachment arrangement disposed on at least one of the upright section pieces and configured for fastening a secondary piece thereto, the attachment arrangement comprising:

a respective male attachment portion disposed on each of the flanges on one side of the at least one upright section piece opposite from the web and extending perpendicularly relative to the web along a longitudinal axis of the flange; and two female attachment portions, each disposed on the web at an opposite side of the at least one upright section piece and each arranged collinear with the longitudinal axis of the respective flange;

wherein the male attachment portions are configured to engage a corresponding female attachment portion of the secondary piece and wherein the female attachment portions are configured to engage a corresponding male attachment portion of the secondary piece, and wherein the secondary piece comprises at least one of a second one-piece upright section piece or a finishing section piece.

2. The high-speed door according to claim 1, wherein the at least one upright section piece incorporates a grid of cavities distributed over an entire transverse section of the upright section piece.

3. The high-speed door according to claim 1, wherein a reinforcing means is engaged in the at least one cavity.

4. The high-speed door according to claim 1, wherein a thermal or an acoustic insulating means comprising a foam is engaged in the at least one cavity.

5. The high-speed door according to claim 1, wherein at least one U-shaped vertical upright of the two U-shaped vertical uprights comprises at least two upright section pieces each having a honeycomb cross section and placed end to end, and connected to a junction platen provided with pins designed to be engaged in the at least one cavity of the at least one upright section piece.

6. The high-speed door according to claim 1, wherein the lintel comprises at least two lintel section pieces connected by a junction element.

7. The high-speed door according to claim 6, wherein at least one flange has a return at a free end turned toward an inside of the at least one upright section piece.

8. The high-speed door according to claim 7, wherein at least one of the male attachment portions is configured to engage with a corresponding female attachment portion of an end section piece provided with a return.

9. The high-speed door according to claim 1, wherein the door comprises two brackets, each bracket having a respective platen abutting the web of a respective upright section piece.

10. The high-speed door according to claim 1, wherein at least one electric member is fixed on an upright whereof a connecting wire is engaged in the at least one cavity of the plurality of upright section pieces forming the U-shaped vertical upright.

11. The high-speed door according to claim 1, wherein at least one of the elements of the group consisting of a transverse connecting bracket, a U-shaped vertical upright of the two U-shaped vertical uprights, a junction element of a crosspiece, and a junction platen of a U-shaped vertical upright of the two U-shaped vertical allows direct or indirect fastening to a structure of a building or the opening.

* * * * *